United States Patent [19]

Koehly et al.

[11] Patent Number: 4,869,794

[45] Date of Patent: Sep. 26, 1989

[54] PROCESS FOR ELIMINATING THE CHLORIDE IONS PRESENT IN CONTAMINATED SOLID WASTES, SUCH AS INCINERATION ASHES CONTAMINATED BY ACTINIDES

[75] Inventors: Gérad Koehly, Bievres; Charles Madic, Thiais; Jean-Louis Saulze, Massy, all of France

[73] Assignee: Commissariat a l'Energie Atomique, Paris, France

[21] Appl. No.: 207,745

[22] Filed: Jun. 16, 1988

[30] Foreign Application Priority Data

Jun. 26, 1987 [FR] France ..... 87 09050

[51] Int. Cl.[4] ..... K02F 1/46

[52] U.S. Cl. ..... 204/130; 204/149

[58] Field of Search ..... 204/130, 149

[56] References Cited

U.S. PATENT DOCUMENTS 4,217,192 8/1980 Lerch et al. ..... 204/149

FOREIGN PATENT DOCUMENTS 0089185 9/1983 European Pat. Off. .
0158555 10/1985 European Pat. Off. .
0160589 11/1985 European Pat. Off. .
1421608 11/1965 France .

*Primary Examiner*—T. M. Tufariello
*Attorney, Agent, or Firm*—Pearne, Gordon, McCoy & Granger

[57] ABSTRACT

The invention relates to the elimination of the chloride ions present in contaminated solid wastes, such as incineration ashes contaminated by actinides.

First the chloride ions are dissolved in an aqueous solution, for example a nitric acid solution of 4 to 6 moles/l, whereafter the chloride ions thus dissolved in the aqueous solution are oxidized, for example, electrochemically, possibly in the presence of an oxidation-reduction couple such as $CO^{3+}/CO^{2+}$, to eliminate them from the solution in the form of chlorine in a gas flow.

The dissolution and oxidation can be performed in the electrolyzer (1), the gas flow being introduced at (10) and eliminated at (13). Then the actinides can be dissolved directly in the electrolyzer by electrolysis in the presence of $Ag^{2+}$ ions.

6 Claims, 1 Drawing Sheet

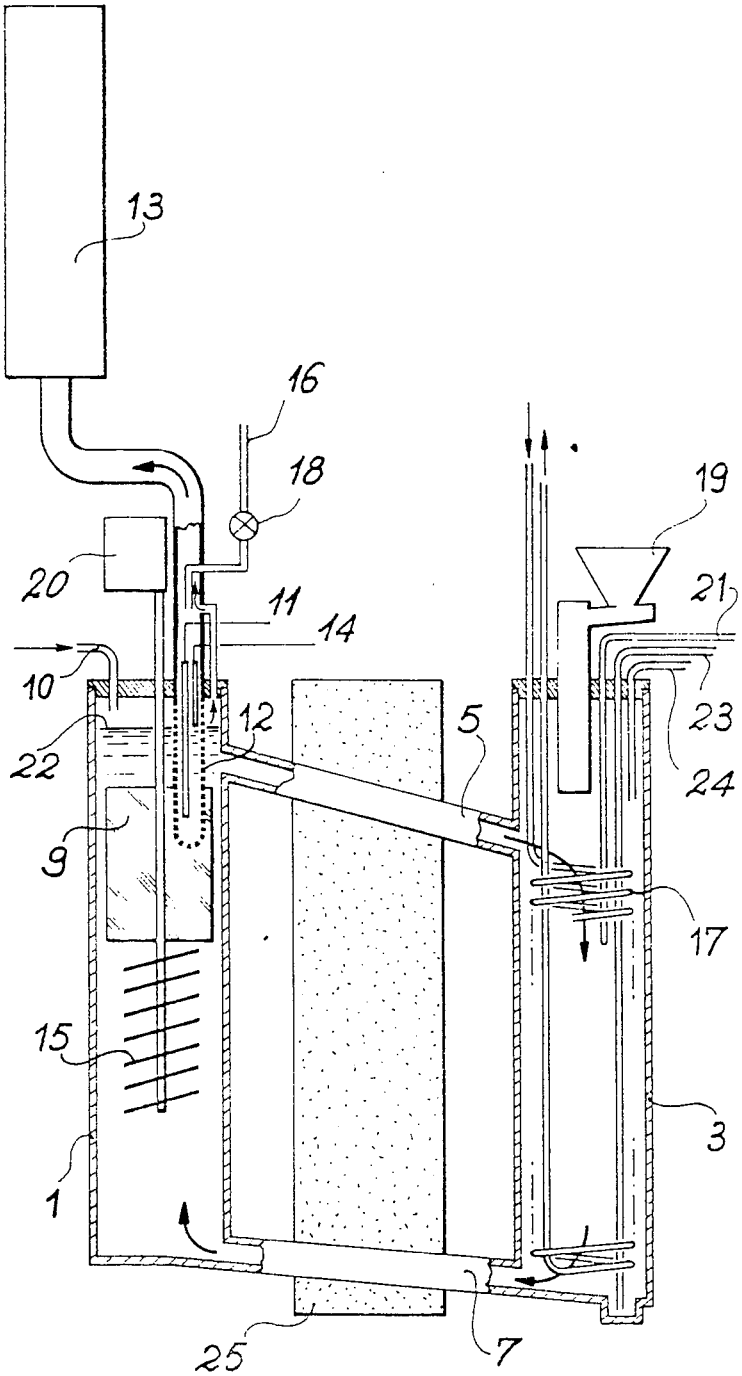
13
16
18
19
20
11
14
21
10
12
5
23
22
24
9
17
15
3
1
25
7

PROCESS FOR ELIMINATING THE CHLORIDE IONS PRESENT IN CONTAMINATED SOLID WASTES, SUCH AS INCINERATION ASHES CONTAMINATED BY ACTINIDES

DESCRIPTION

The invention relates to a process for eliminating the chloride ions present in contaminated solid wastes, such as incineration ashes contaminated by actinides.

One of the problems frequently encountered in nuclear installations is of course the recovery of the actinides, such as plutonium and/or neptunium, present in solid wastes coming either from the manufacture of nuclear fuel elements, or from the treatment of irradiated nuclear fuels. The wastes can be formed by ashes originating from the incineration at 800°-900° C. of combustible wastes heavily contaminated with plutonium, something which leads to the obtaining of calcined ashes in which plutonium is present in the form of an oxide or other refractory compound—i.e., in a form difficult to recover in solution. Amongst the wastes which are capable of being thus treated, there are certain laboratory wastes, more particularly wastes based on plastics such as polyvinyl chloride, something which leads to the formation of ashes having high chloride ion contents which can reach up to 30% by weight.

The treatments capable of being used for recovering plutonium from wastes of the kind specified include methods based on the solubilization of plutonium in the form of Pu(VI) ions in a nitric medium by oxidation using silver (II), which can be regenerated by electrolysis, as disclosed in European Patent Application No. 158555 filed on 22 Mar. 1985. That process is very advantageous, but when the solid wastes contain chloride ions, first of all such chloride ions must be eliminated before proceeding to the phase of solubilizing plutonium by the action of Ag(II), since the presence of chloride ions in the wastes would lead to the elimination of the Ag(I) ions of the solution in the form of AgCl, thus making it impossible to regenerate Ag(II) by electrolysis and therefore dissolve the plutonium.

One prior art method of eliminating chloride ions before proceeding to the solubilization of plutonium is to wash the wastes with water, as disclosed in the aforementioned French Patent. However although this technique of washing with water is effective, it has many disadvantages for use on an industrial scale.

Before carrying out the phase of solubilizing plutonium in an electrolyzer, the wastes must be washed with water, whereafter the wastes must be separated from the aqueous washing solution, something which requires the use of two successive specific apparatuses.- Then the washed solid wastes must be transferred to the oxidization dissolution apparatus i.e., the electrolyzer. Moreover, this method of eliminating the chloride ions produces a fresh liquid effluent contaminated by alpha-emitting actinides, such as plutonium and americium, which have a high content of $Cl^-$ ions, and this is difficult to treat.

It is precisely an aim of the invention to provide a process for eliminating the chloride ions contained in contaminated solid wastes, thus enabling the aforementioned disadvantages to be obviated.

The process according to the invention for eliminating the chloride ions present in contaminated solid wastes consists in disolving the chloride ions in an aqueous solution and in oxidizing the chloride ions thus dissolved in the aqueous solution to eliminate them from the solution in the form of chlorine in a gas flow.

The chloride ions can be dissolved by contacting the wastes with a suitable aqueous solution. Use can be made of acid solutions, more particularly an aqueous solution of nitric acid advantageously having a nitric acid concentration of 4 to 6 moles/l.

The chloride ions present in solution can then be oxidized electrochemically, directly by passing an electric current through the solution, or indirectly via an oxidizing agent regenerated by electrolysis.

The chloride ions can therefore be dissolved and oxidized in the same apparatus, more particularly in the electrolytic cell, which will be used for the subsequent dissolution of the actinides such as plutonium and neptunium. The process according to the invention therefore eliminates the use of different successive apparatuses and the transfer of the wastes from the washing apparatus to the electrolytic cell for the dissolution of plutonium and/or neptunium.

The solution used for dissolving the chloride ions can also be an aqueous solution of nitric acid whose nitric acid concentration is suitable for the subsequent stage of dissolving the plutonium and/or neptunium.

To perform the direct oxidation electrochemically of the chloride ions dissolved in the aqueous solution of nitric acid, it is enough to apply between the electrodes of the electrolysis cell a potential high enough for the oxidation reaction of the chloride ions in gaseous chlorine, whose normal apparent potential is 1.36 volt/ENH, to be able to take place on the anode. This can be done by passing an intense enough constant current through the electrolyzer.

To oxidize the chloride ions indirectly by electrochemical means, use is made of an oxidation-reduction couple whose normal apparent potential is higher than 1.36 volt/ENH, the oxidized element of the oxidation-reduction couple being regenerated directly by electrolysis in the cell.

The oxidation-reduction couples which can be used include the couple $Co^{3+}/Co^{2+}$, whose normal apparent potential is 1.83 volt/ENH.

Of course, other oxidation-reducing couples can be used, as long as they are compatible with the presence of $Cl^-$ ions in solution.

During oxidation the chlorine is eliminated and given off, being entrained by a gas flow, for example, air or an inert gas such as nitrogen, whereafter the chlorine can be separated from the gas flow by conventional techniques, for example, by passing the gas flow over a soda-lime trap.

The only fresh waste produced by the process according to the invention may therefore be a soda-lime trap which has an extremely low level of radioactive contamination and can be readily stored in surface sites. The treatment of the fresh waste therefore causes no problem, and this was not the case with the chlorinated radioactive effluents obtained by the prior art process.

The process according to the invention can be put into effect in a conventional electrolysis cell, more particularly, in an electrolyzer such as that disclosed in European Patent Nos. 160589 or 0158555.

To put the process according to the invention into effect, an aqueous solution of nitric acid is introduced into the electrolyzer which has a nitric acid concentration of 4 to 6 moles/l, and then the contaminated wastes, the whole then being agitated for long enough to solubilize at least 95% of the chloride ions. Preferably the surface of the solution is swept with a gas flow, such as air, during the whole duration of the solubilization treatment, which is generally less than 1 hour. Operations can be carried out at ambient temperature or a higher temperature, ranging, for example, between 20° and 70° C.

After this operation, the chloride ions are oxidized in the electrolyzer to give gaseous chlorine. This is done by passing through the electrolyzer a continuous flow having an intensity high enough for the anode potential to be higher than 1.36 volt/ENH. During electrolysis the sweeping by gas is maintained to eliminate the chlorine released by the reaction in the gas flow. The duration of electrolysis is determined in dependence on the concentration of the solution in chloride ions, to make sure that the chloride ions are practically totally eliminated. Duration of 1 to 3 hours are generally enough.

Generally the temperature if higher than ambient temperature, since the solution is heated by the passage of electric current. Operations are therefore performed at temperatures of between 40° and 60° C.

When the chloride ions are indirectly oxidized by means of an oxidation-reduction couple, operations are performed in the same way, after adding at least one of the elements of the desired couple to the solution.

When the elimination of the $Cl^-$ ions in the form of $Cl_2$ has been completed, the actinides such as plutonium, americium and uranium can be solubilized in the same electrolyzer. To this end, a silver (II) compound, such as silver nitrate, is added to the solution, and a potential difference is maintained between the electrodes which is enough to continuously regenerate the $Ag^{2+}$ ions which were used for the oxidation and dissolution of the actinides present in the wastes. At the end of the operation the solid wastes are separated from the solution, which contains the majority of the radioactive elements, such as plutonium, americium and uranium.

The process according to the invention is thus very advantageous, since the successive stages of eliminating the chloride ions and dissolving the contaminating radioactive actinides can be performed in the same electrolysis cell, something which eliminates the operations of liquid/solid separation and transfer previously required. Moreover, the process according to the invention does not produce fresh aqueous effluents, such as chlorinated effluents contaminated by plutonium, americium and/or uranium.

The invention will be more clearly understood from the following merely illustrative, non-limitative Examples thereof with reference to the accompanying drawing, which shows diagrammatically an electrolysis cell which can be used to put the process according to the invention into effect.

Referring to the drawing, an electrolysis cell comprises a first tube 1 and a second tube 3 of identical diameter so interconnected by ducts 5 and 7 as to enable the mixture of wastes and solution to flow (in the direction shown by the arrows) from the second tube 3 to the first tube 1 via the duct 5 in overfall and from the first tube 1 to the second tube 3 via the duct 7. The two tubes 1 and 3 have a definite geometry and can, for example, have the following dimensions: a diameter of 16 cm and a total height of 1 m, corresponding to a useful capacity of 20 l. The tubes 1 and 3 can be made of plexiglass, tantalum or glass. The first tube 1 comprises the means required for electrolysis, the agitation of the mixture of solid and solution, and the trapping of the gaseous products during electrolysis. Thus, the first tube 1 comprises an anode 9 which is preferably tubular, to present a large surface, and a cathode 11 disposed in a cathode compartment 12 partly bounded by a porous wall of electric insulating material and connected to a vacuum circuit 13 having a soda-lime trap and a gaswashing column. A flow of gas, for example, air, is introduced at 10 into the first tube to sweep the surface of the liquid. The gaseous products formed during electrolysis, more particularly chlorine, are therefore captured and entrained, after dilution in the sweeping gas, through a soda-lime trap retaining the chlorine, and a washing column retaining the nitrogeneous products, any traces of hydrogen formed being evacuated by the ventilation of the confinement enclosure in which the device is disposed.

The cathode compartment which can have, for example, a diameter of 5 cm and a volume of about 0.5 l has more than one level detector 14 and a duct via which an electrolyte is introduced into the cathode compartment 12. The conduit 16 comprises a valve 18 connected to the level detector 14 in the compartment, to control the opening of the valve 18 when the level is below the required value 22, and to close the valve 18 when the liquid level has reached the required value. It will also be noted that the cathode compartment is disposed opposite the conduit 5, something which facilitates the evacuation of heat given off in the component, by the flow of the mixture of solid and liquid entering the conduit 5. A turbine 15 which can be driven by an electric motor 20 ensures the mixing and circulation of the mixture of solid and liquid between the tubes 1 and 3.

The second tube 3 has means for ensuring the cooling of the mixture of solid and solution, which are formed by a coil 17 which is immersed in the solution and through which a cooling liquid flows. It also comprises a feed hopper 19 for introducing the wastes to be treated, means 21 to detect the completion of the dissolution of the actinides, means 23 for withdrawing the solution obtained, and a conduit 24 for introducing reagents into the device, either silver oxide, nitric acid and if necessary the intermediate use for oxidizing the chloride ions.

To increase safety, the device also comprises disposed between the two tubes a screen 25 of a neutron-consuming material, for example, plaster or boronic polyethylene.

The means 21 for detecting the completion of the dissolution of the actinides can be formed by an optical probe able to detect the colouring of Ag(II), something which indicates that the silver ions are no longer used for oxidizing plutonium. A probe can also be used for measuring the density of the liquid, since the completion of the reaction may be detected by obtaining a stable density. It is also possible to use a probe for measuring the giving-off of gas on the anode.

The means 23 for withdrawing the solution obtained comprise an emptying duct which discharges at the bottom end of the second tube.

The turbine 15 present in the first tube 1 can be replaced by a pump or any other suitable means for ensuring vigorous agitation in the first tube and circulating the mixture of solid and liquid from the first tube to the second tube in the direction indicated by the arrows.

The porous separating wall of the cathode compartment 12 can be made of fritted glass or fitted ceramics, for example, fritted alumina.

To treat wastes containing chloride ions in the aforedescribed electrolysis cell, the procedure is as follows.

An aqueous solution of nitric acid having the required nitric acid concentration is first introduced into the cell via the duct 24. Then the contaminated wastes are introduced by the hopper 19 and the turbine 15 is started to stir the mixture of wastes and aqueous solution of nitric acid and circulate it between the tubes 1 and 3. At the same time the first tube 1 is swept with air, the air being introduced via the duct 10 and extracted via the vacuum circuit 13. When the dissolution of the chloride ions is completed, a potential difference is set up between the anode 9 and the cathode 11 to pass a direct electric current of adequate intensity through the aqueous solution, while operating the turbine 15 to mix and circulate the mixture, and maintaining the sweeping of air via 10. During this electrolysis the chloride ions are oxidized into gaseous chlorine which is eliminated by the gas flow in the vacuum circuit 13.

When all the chlorine has been eliminated, the contaminating actinides can be dissolved. In this case the required reagent, for example, silver oxide or silver nitrate, is introduced via the duct 24, and a potential difference suitable for regenerating the silver II is maintained between the cathode and the anode. Electrolysis is performed long enough to dissolve the contaminating elements while always keeping the turbine operating to ensure the mixing and circulation of the mixture and maintaining the air sweeping via 10. The completion of the reaction is detected by the detector 21, and the solution is cooled via the coil 71 when necessary to maintain its temperature at the required value.

The following are Examples of the treatment of contaminated wastes containing chloride ions by the process according to the invention.

EXAMPLE 1

In this Example, use was made of a laboratory glass electrolyzer comprising a platinum anode having a surface of 36 $cm^2$ and a cathode formed by a platinum wire disposed in a compartment separated by a glass frit of porosity no. 4 containing 8 ml of 8M nitric acid. The electrolyzer was closed by a cover and connected to a vacuum line having a silver nitrate bubbler.

First 100 ml of a solution of nitric acid with 4 moles/l was introduced into the electrolyzer, whereafter 10 g of ashes having a chloride ion content of 2.1% by weight was added, and the mixture of ashes in solution was mixed for 2 h 30 by means of a magnetic bar. Then a potential difference was applied between the anode and the cathode to pass a direct current of 1 A through the electrolyzer for 1 hour, while at the same time sweeping the electrolyzer with air. During the electrolysis phase the temperature in the electrolyzer was raised to about 50° C. as a result of the passage of the electric current.

During the experiment the chloride ion concentration of the solution was measured before the electrolysis phase and at the end of electrolysis. The results obtained were as follows:

chloride ion concentration after the dissolution stage: 0.06 moles/l, and chloride ion concentration after one hour's electrolysis: $3.7.10^{-3}$ moles/l.

At the end of electrolysis, therefore, the chloride ion concentration was only 6% of the initial chloride ion concentration of the solution.

The presence was also noted of an abundant white precipitate of AgCl in the bubbling flask containing the silver nitrate solution.

The process according to the invention therefore enabled chloride ions to be satisfactorily eliminated in the form of $Cl_2$.

EXAMPLE 2

In this Example, the same operational mode was used as in Example 1 to treat 10 g of ashes having a chloride ion content of 2.1% by weight, using the same electrolyzer, but interposing a soda-lime trap on the vacuum line upstream of the bubbler filled with the silver nitrate solution.

The chloride ions were first dissloved by the performance of the following stages:

(a) agitation of the mixture for one hour, (b) agitation of the mixture at ambient temperature for one hour while swept with air, and (c) agitation for one hour at a temperature of 60° C., while swept with air.

Then electrolysis was performed with a constant intensity of 1 A with air sweeping at a temperature of 60° C. for one hour, as in Example 1.

Measurements of the chloride ion concentration of the solution performed after these different stages gave the following results:

0.06 moles/l after stage(a), same results after stages (b) and (c), and $3.7.10^{-3}$ moles/l at the end of electrolysis.

It was thus noted that the quantity of $Cl^-$ ions dissolved after one hour was identical with that obtained after 2 h 30 of agitation. Moreover, even with air sweeping, the concentration of $Cl^-$ ions remained constant, indicating that the entrainment of $Cl^-$ ions in the form of HCl by air is a negligible process.

As in Example 1, the residual concentration of chloride ions after the electrolysis phase was 6% of the initial concentration.

It was also observed that there was no white precipitate in the silver nitrate bubbler, indicating that chlorine was efficiently trapped by the soda-lime trap.

EXAMPLE 3

In this Example, the electrolysis cell illustrated in the drawing was used to treat active ashes containing 23% by weight of chloride ions and about 3% by weight of plutonium. 6 1 of nitric acid of 4 moles/l were introduced into the electrolysis cell, whereafter 554 g of ashes were added and the whole was agitated for one hour while swept with air.

Then electrolysis was performed by passing through a current having an intensity of 80 A for 3 hours at a temperature of 40° to 60° C. with sweeping by air.

At the end of electrolysis the chloride ion concentration of the solution was determined. It was $10^{-3}$ moles/l. It was therefore noted that only 0.17% of the chloride ions initially present in the ashes remained.

An analysis of the chloride ions content of the solution during electrolysis enabled the farad yield to be calculated. It was 50% during the essential part of the electrolysis phase.

EXAMPLE 4

In this Example, 916 g of ashes identical with those in Example 3 were treated, the stages of dissolution of the $Cl^-$ ions and electrolysis with air sweeping being performed in the same conditions. The residual chloride ion concentration of the solution after three hours of electrolysis was $4.5.10^{-3}$ moles/l.

The residual chloride ion content therefore represented 0.5% of the initial chloride ions of the ashes. Calculation of the farad yield showed that it was 54% during the main part of the electrolysis phase.

The process according to the invention therefore very effectively eliminated the chloride ions.

EXAMPLE 5

In this Example, 5 g of ashes were treated containing 7.8% by weight of $Cl^-$ ions in a laboratory electrolyzer similar to that of Example 1, except that the platinum anode had a surface area of 3.33 $cm^2$ and sweeping was with nitrogen.

The ashes were dispersed in 100 ml of nitric acid of 4 moles/l, and the whole was agitated for one hour. Electrolysis was then performed with an electrolysis current of 0.5 A for 118 minutes at a temperature of 80° C. During dissolution and electrolysis, nitrogen sweeping was performed with a flow rate of 1.3 l/h.

After electrolysis the residual chloride ion concentration of the solution was $1.9.10^{-3}$ moles/l, corresponding to an elimination performance of 98.3%.

EXAMPLE 6

In this Example, 5 g of ashes identical with those of Example 5 were treated using the same operational mode, but adding to the solution during electrolysis 0.1 moles/l of $Co^{2+}$ ions (in the form of cobaltous nitrate) to perform the oxidation of $Cl^-$ ions in solution.

After 82 minutes of electrolysis performed in the same conditions as those of Example 5, the residual chloride ion concentration was $1.9.10^{-3}$ moles/l.

It was therefore noted that the presence of the CoII/-CoIII couple resulted in a 30% gain on the duration of electrolysis required to obtain the same level of elimination of the $Cl^-$ ions in the form of $Cl_2$.

We claim:

1. A process for eliminating the chloride ions present in contaminated solid wastes, comprising the steps of contacting the wastes with an aqueous solution of nitric acid at a concentration of 4 to 6 moles/l to dissolve the chloride ions and oxidizing the chloride ions thus dissolved in the aqueous solution to eliminate them from the solution in the form of chlorine in a gas flow, the step of oxidizing the chloride ions including passing current through the solution to electrochemically oxidize the dissolved chloride ions or contacting the wastes in the solution with an oxidation-reduction couple whose oxidized element is regenerated by electrolysis.

2. A process according to claim 1, wherein the aqueous solution of nitric acid comprises 5 to 6 moles/l of nitric acid.

3. A process according to claim 1, wherein the oxidation-reducing couple is the couple $Co^{3+}/Co^{2+}$.

4. A process according to claim 1, wherein the chlorine eliminated from the solution is recovered by passing the chlorine-containing gas flow over a soda-lime trap.

5. A process for recovering the actinides present in solid wastes also containing chloride ions, comprising the steps of:

(1) bringing the solid wastes into contact, with agitation in an electrolysis cell comprising an anode and a cathode, with an aqueous solution of nitric acid having a nitric acid concentration of 4 to 6 moles/l for a period adequate to dissolve at least 95% of the chloride ions;

(2) applying between the anode and the cathode of the cell a potential difference adequate to oxidize the chloride ions to chlorine, whereafter the gaseous chlorine thus released is entrained in a gas flow; and (3) adding to the aqueous solution a silver compound and maintaining between the anode and the cathode of the cell a potential difference adequate to continuously regenerate the $Ag^{2+}$ ions which were used for oxidation and to dissolve the actinides present in the waste.

6. A process according to claim 5, wherein step (2) includes adding a compound of coblat II to the aqueous solution.

* * * * *